US005310174A

United States Patent [19]

Thomas

[11] Patent Number: 5,310,174

[45] Date of Patent: May 10, 1994

[54] PAPER CUSHION AND NOISE SUPPRESSOR

[75] Inventor: David Thomas, Wabash, Ind.

[73] Assignee: Martin Yale Industries, Inc., Wabash, Ind.

[21] Appl. No.: 943,810

[22] Filed: Sep. 11, 1992

[51] Int. Cl.[5] ..... B65H 5/00

[52] U.S. Cl. ..... 271/225; 271/184; 271/902

[58] Field of Search ..... 271/225, 184, 902, 224; 493/419, 420, 421, 442

[56] References Cited

U.S. PATENT DOCUMENTS 2,761,682 9/1956 Buccicone ..... 271/224

3,907,128 9/1975 Cathers ..... 271/224 X

*Primary Examiner*—David H. Bollinger

*Attorney, Agent, or Firm*—Willian Brinks Hofer Gilson & Lione

[57] ABSTRACT

A noise suppression device for a buckle-type folding machine and a method for folding paper. The device includes an elongated sheet stop with a plurality of tabs. Each tab contains an opening wherein a bumper is fitted. The bumper contacts the sheet material during the operation of the folding machine. Paper is folded by passing it through a roller nip.

14 Claims, 1 Drawing Sheet

PAPER CUSHION AND NOISE SUPPRESSOR

BACKGROUND OF THE INVENTION

The invention relates to a paper cushion noise suppression device used in folding machines for folding sheet material. Folding devices using stops and rollers to create buckles in the sheet material which are drawn into roller pairs forming a fold, are common in the art.

The problem with these folding devices is that noise is created when the high speed roller pairs force the sheet material against the stops.

The present invention is directed to a paper cushion noise suppression device for suppressing the noise created when sheet material is forced against stops during operation of the folding machine. This paper cushion and noise suppression device is designed for economic manufacture and assembly, using few parts.

SUMMARY OF THE INVENTION

The invention provides a bumper as a paper cushion noise suppression device for a buckle-type folding machine for sheet material. In one embodiment, the invention comprises an elongated stop having at least one opening formed therein, and at least one bumper fitted in the opening for preventing contact of sheet material with the stop during operation of the folding machine.

In another embodiment, the invention provides a paper cushion noise suppression device for a buckle-type folding machine comprising an elongated stop, a plurality of tabs attached to the stop having at least one opening formed in each tab, and a bumper fitted in the opening of each tab for contacting with sheet material during operation of the folding machine.

One advantage of the invention is that it is an inexpensive means for reducing noise in standard buckle-type folding machines. A further advantage is that the paper is cushioned from impact against the paper-stop. These and other advantages are achieved by the present invention.

DETAILED DESCRIPTION OF AN EMBODIMENT

Figure 1:
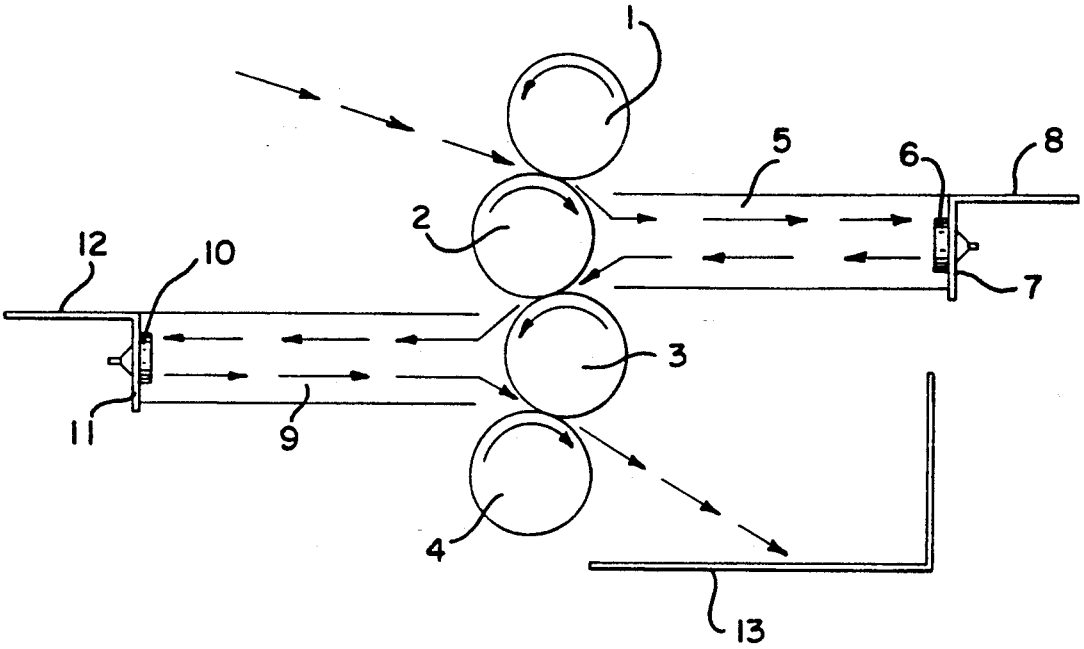
FIG. 1 is a sectional view of a four roller folding machine with noise suppression device.

Referring to FIG. 1, a standard four roller buckle-type folding machine is shown in sectional view. As represented by the directional arrows, the sheet to be folded is fed between rollers 1 and 2 into first fold pocket 5. The paper is forced into bumper 6 which is fitted in an opening in tab 7 formed in the elongated sheet stop 8. The buckled sheet is caught between rollers 2 and 3 and forced into second fold pocket 9 creating a first fold. The sheet is forced against bumper 10 which is inserted in an opening in tab 11 formed in elongated sheet stop 12. A second buckle is formed as the sheet is forced against the bumper 10. The buckle is caught between rollers 3 and 4 and a second fold is created. The sheet is ejected from the rollers 3 and 4 into the receiver tray 13.

Figure 2:
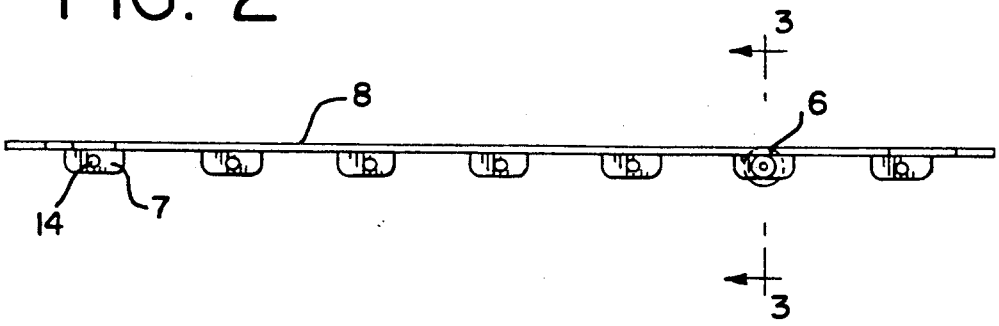
FIG. 2 is a front elevational view of the elongated sheet stop.

Referring to FIG. 2, the elongated sheet stop 8 is shown with a plurality of tabs 7 having openings 14 formed therein. The bumper 6 is shown in phantom.

Figure 3:
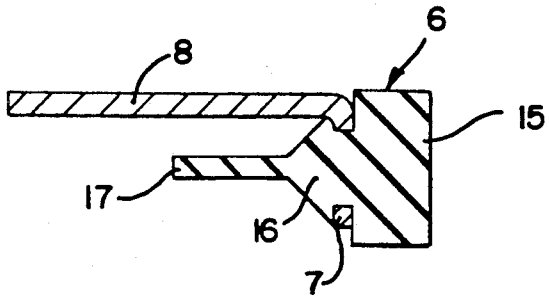
FIG. 3 is a sectional view taken along the axis 3—3 of FIG. 2 illustrating the noise suppression device.

Referring to FIG. 3 a sectional view of the elongated sheet stop 8 is shown with the bumper 6 inserted in the opening 14 in tab 7 of the elongated stop 8. The bumper 6 has a bumper head 15 preferably made of rubber or a synthetic-rubber material for cushioning the sheet material and suppressing the noise caused when the sheet hits a stop during operation of the folding machine. The bumper also has a catch portion 16 that prevents the bumper 6 from being dislodged from its position in the opening 14 of the tab 7. The tail portion 17 of the bumper 6 is provided for easy assembly of the bumper 6 in the opening 14. During assembly the tail 17 can be grasped and pulled through the opening 14 until the catch 16 is fully through the opening 14.

In operation the sheet as shown by the arrows in FIG. 1 is prevented from contacting the elongated sheet stop by the bumpers 6 and 10, thus cushioning the paper or sheet and reducing the noise.

Thus, while the invention has been described in reference to a certain embodiment, those skilled in the art will recognize modification of structure, arrangement, composition and the like that can be made to the present invention, it still will fall within the scope of the invention as hereafter claimed.

I claim:

1. A paper cushion noise suppression device for a buckle-type folding machine comprising:

an elongated sheet stop rigidly fixed to said folding machine;

at least one bumper non-movably fixed to said sheet stop for preventing contact of a paper sheet with the stop during operation of the folding machine.

2. The device of claim 1 wherein the bumper is comprised of rubber.

3. The device of claim 1 wherein the bumper is comprised of a soft elastic material.

4. The device of claim 1 wherein the bumper has formed therein a head portion for contacting with the paper sheet and a catch portion for preventing the bumper from being dislodged during operation of the folding machine.

5. A paper cushion noise suppression device for a buckle-type folding machine comprising:

an elongated sheet stop;

a plurality of tabs attached to said elongated sheet stop, said tab having at least one opening formed therein;

a bumper fitted in said opening of said tab for contacting with sheet material during operation of the folding machine.

6. The device of claim 5 wherein the bumper has formed therein a tail portion for allowing the bumper to be pulled through the opening during assembly of the folding machine.

7. The device of claim 5 wherein the bumper is comprised of a soft elastic material.

8. The device of claim 5 wherein the bumper has formed therein a head portion for contacting with the sheet material and a catch portion for preventing the bumper from being dislodged during operation of the folding machine.

9. A paper cushion noise suppression device for a buckle-type folding machine comprising:

an elongated sheet stop;

a plurality of tabs attached to said elongated sheet stop, said tab having at least one opening formed therein;

a bumper having a head portion for preventing sheet material from contacting stop and tab, a catch portion for fitting through said opening in said tab and preventing said bumper from being dislodged, and a tail portion for allowing said catch portion to be pulled through said opening.

10. The device of claim 9 wherein the bumper is comprised of a soft elastic material.

11. The device of claim 9 wherein the elongated sheet stop and the plurality of tabs are formed in a unitary member.

12. The device of claim 9 wherein the sheet material comprises paper.

13. The device of claim 9 wherein the head portion comprises a soft elastic cylindrical cushion.

14. The device of claim 9 wherein the catch portion comprises an elastic conical member having a tail side for connecting with the tail portion and a base portion for contacting with a back surface of the tab.

* * * * *